United States Patent [19]

Vulcano et al.

[11] 4,091,598

[45] May 30, 1978

[54] SEMI-AUTOMATIC BAGGING MACHINE

[75] Inventors: Vincent N. Vulcano, New York, N.Y.; Maurice W. Friedman, 548 Barnard Ave., Woodmere, N.Y. 11598

[73] Assignee: Maurice W. Friedman, Woodmere, N.Y.

[21] Appl. No.: 721,957

[22] Filed: Sept. 10, 1976

[51] Int. Cl.[2] ..... B65B 5/02; B65B 43/30

[52] U.S. Cl. ..... 53/241; 53/384; 53/386

[58] Field of Search ..... 53/29, 183, 241, 256, 53/384, 385, 386

[56] References Cited

U.S. PATENT DOCUMENTS

| | | | |
|---|---|---|---|
| 3,802,156 | 4/1974 | Dahlberg | 53/384 |
| 3,895,480 | 7/1975 | Lombardo | 53/241 X |
| 3,974,628 | 8/1976 | Konstantin | 53/291 |
| 3,982,377 | 9/1976 | VanderPool | 53/241 X |

*Primary Examiner*—Robert Louis Spruill

*Attorney, Agent, or Firm*—Stephen E. Feldman; Marvin Feldman

[57] ABSTRACT

A semi-automatic bagging machine for assisting an operator in bagging clothing garments is disclosed. The bags are formed from a polyethylene material supplied in continuous, tubular form from a roll, by transversely sealing the material at a desired location and severing it near the seal, thereby closing the top of one bag and leaving an open end of the continuous material for the bottom of the next bag. A series of perforated, hollow plastic spheres, of the type known as "wiffle balls", is supported by the apparatus, within the path of the tubular material, for spreading and maintaining the material apart, thereby greatly facilitating the operator in manually drawing the material over the garment.

6 Claims, 7 Drawing Figures

FIG.6
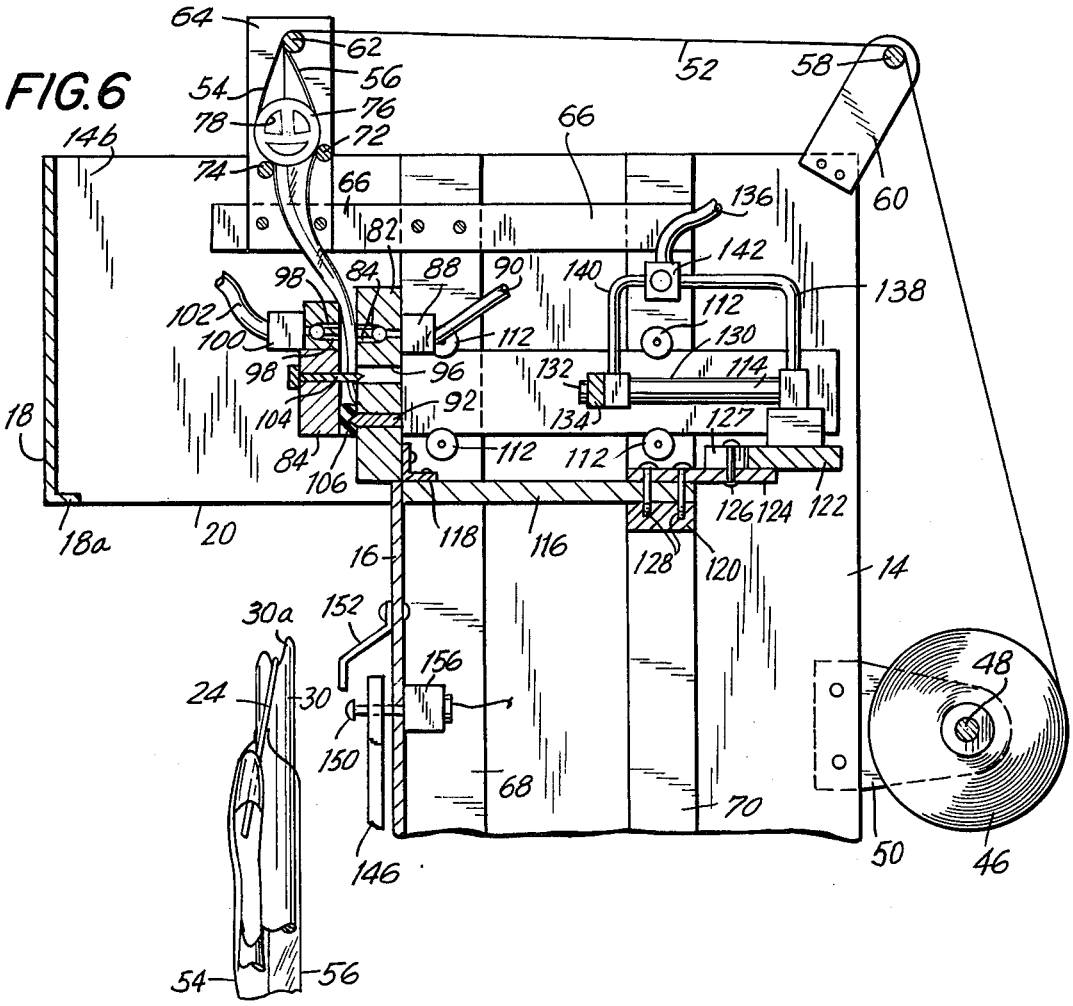
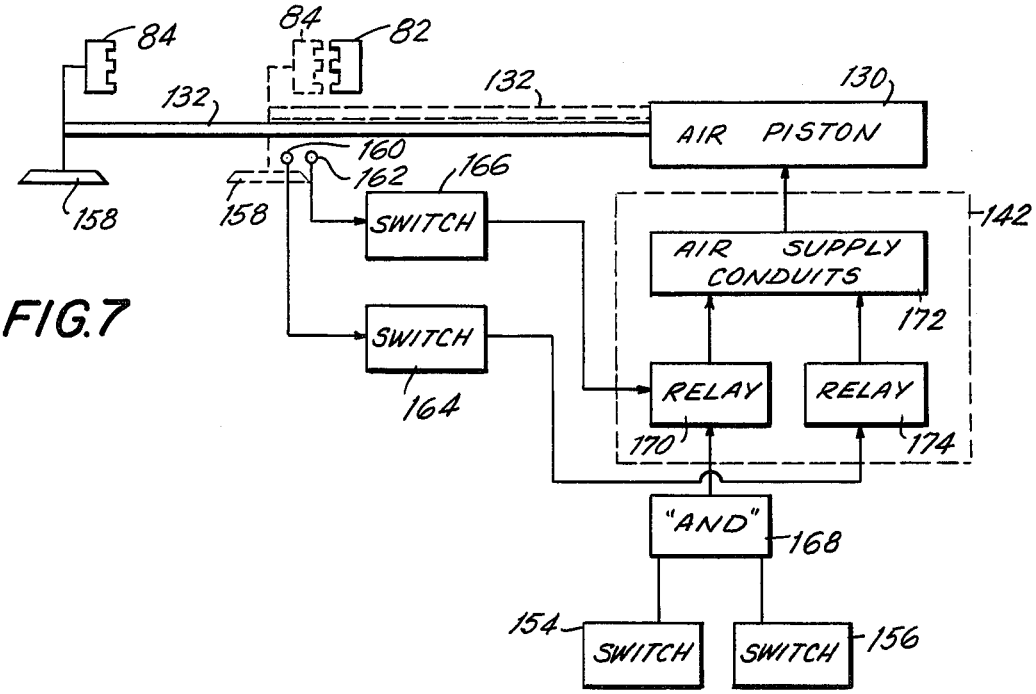
FIG.7

SEMI-AUTOMATIC BAGGING MACHINE

This invention relates generally to bagging machines and, more particularly, to a semi-automatic bagging machine used to provide bags for clothing garments and the like.

It is well-known in the art to package clothing garments in bags closed at the top and sides, and open at the bottom, with the garment itself being supported by a wire or similar hanger which extends through an opening at the top edge of the bag. Frequently, the bags are provided for dry-cleaned or laundered garments, with the bag itself being formed of an appropriate plastic material, such as polyethylene or the like. The polyethylene is usually stored in the form of a roll of tubular material.

In many dry-cleaning or laundering establishments, the clothing garment is inserted into the tubular material manually, and no apparatus is provided, other than a support for the roll, for aiding the operator in forming the bag for the garment. Specifically, in many dry-cleaning establishments, the roll of tubular, bagging material is supported above a garment to be bagged, and when the operator desires to "bag" the garment, the operator takes the open end of the tube and pulls the material over the garment so that the garment fits within the tube, as the garment is supported by a hanger or the like. In order to assist the operator, the tubular material may be formed to include perforations which allow the bag to be detached from the rest of the material after the material has been pulled over the garment.

There are several difficulties with the "manual" technique described above. The most serious disadvantage is that the procedure is very time-consuming and, therefore, quite inefficient. Another disadvantage is that since the perforations are pre-formed on the roll, it is necessary to utilize several different rolls to accommodate garments of different lengths, i.e., men's sport coats and womens's long dresses.

In order to overcome these difficulties, it has been proposed to provide a semi-automatic bagging machine which would automatically seal the polyethylene material at a desired location and sever the material near the seal, thereby closing the top of one bag and leaving an open end of the continuous, tubular material for the bottom of the next bag. Such a machine is disclosed in U.S. Pat. No. 3,755,984, which issued to Charles C. Vanderpool on Sept. 4, 1973.

The Vanderpool patent discloses a semi-automatic bagging machine which utilizes a knife blade and a sealing element which are actuated to seal and cut the top of the garment bag, once the polyethylene, tubular material has been pulled over the clothing garment. This patent also discloses the use of a vacuum source which functions to hold the tubular material apart at the severed end, so that the material may be pulled from the roll over the next garment.

In theory, the semi-automatic bagging machine of the Vanderpool patent offers several advantages over the manual technique described above, namely, the Vanderpool machine is more efficient and enables a single, continuous roll of tubular material to be used for garments of different lengths since the machine cuts and seals the material to form the bag only after the operator has pulled the desired length of material sufficient to enclose the garment from the roll. However, the Vanderpool machine has been less than satisfactory in actual operation. This has been due, in large measure, to the nature of the polyethylene, tubular material since the "faces" of the tube have a tendency to stick together, even after they have been separated by the vacuum source. This makes it very difficult to pull the tubular material over the garment in a quick and efficient manner.

This problem with polyethylene, tubular materials stored on rolls has been long recognized and the prior art has made several attempts to provide ways for overcoming the tendency of the tube faces to stick together. By way of example, there is disclosed in U.S. Pat. Nos. 3,181,773, 3,287,881 and 3,308,601, several different devices for spreading the faces of the tubular material apart, prior to the time that the material is drawn over a clothing garment. Thus, in the 3,181,773 and 3,287,881 patents, which issued to M. Jelling et al, there are disclosed devices having spreading arms, floaters and rollers which are all provided in attempts to spread open the tubular material. Similarly, in U.S. Pat. No. 3,308,601, which issued to J. P. Masters, there is disclosed a device having the combination of rollers and a pyramid-shaped head which is also provided to separate the opposite faces of the tubular material, prior to the time that the material is pulled over the garment. Unfortunately, none of these devices have worked satisfactorily and the tubular, bagging material still exhibits the tendency of its opposite faces sticking together, even after the material has passed over the various spreading devices.

Accordingly, it is a broad object of the present invention to provide a semi-automatic bagging machine which operates efficiently to provide garment bags of different lengths, depending on the size of the garment inserted within the bag.

Another object of the present invention is to provide a semi-automatic bagging machine which overcomes the difficulties of bagging machines built according to the prior art.

Yet another object of this invention is to provide a semi-automatic bagging machine having means for untangling the tubular material supplied from the storage roll and for spreading apart the faces of the tubular material and for preventing the faces from sticking together after they have been spread apart, thereby allowing the tubular material to be quickly and easily pulled over a clothing garment.

A still further object of the present invention is to provide a semi-automatic bagging machine which is relatively inexpensive to manufacture and which operates with a high degree of satisfaction.

These and other objects of the present invention are attained by providing a semi-automatic bagging machine for sequentially forming individual bags for clothing garments, which bags are closed at the sides and one end and open at the other end, from a supply of a continuous, tubular material. The semi-automatic bagging machine includes vacuum means for engaging and holding open the faces of the material at the leading end of the bag and means for supporting a garment for insertion into the tubular material as the material is pulled over the garment. Guide means is provided for guiding the tubular material from a supply location to the vacuum means. The guide means includes a plurality of spherical balls which are disposed within the tubular material and which are supported by the bagging machine for independent movement within the tubular material. The spherical balls untangle the tubular material and spread apart the opposite faces of the material. The spherical balls also overcome the tendency of the faces to be attracted toward each other thereby maintaining the faces spread apart as the tubular material is pulled over the garment. Means selectively operable to seal the faces of the tubular material together and to sever the material adjacent the seal after the tubular material has been pulled over the garment, thereby forming an individual bag for the garment and a new leading end of the material for the next garment bag, is also provided.

The above brief description of the present invention, as well as further objects, features and advantages thereof, will become more readily apparent upon consideration of the following detailed description of a preferred, but nonetheless illustrative, embodiment, when taken in conjunction with the following drawings, wherein:

FIG. 6 is a partial sectional view, similar to that of FIG. 3, but showing the cutting and sealing element of the apparatus in a position severing and sealing the tubular material; and FIG. 7 is a schematic, block diagram view showing the circuit which controls the movement of the cutting and sealing element of the present invention.

Figure 1:
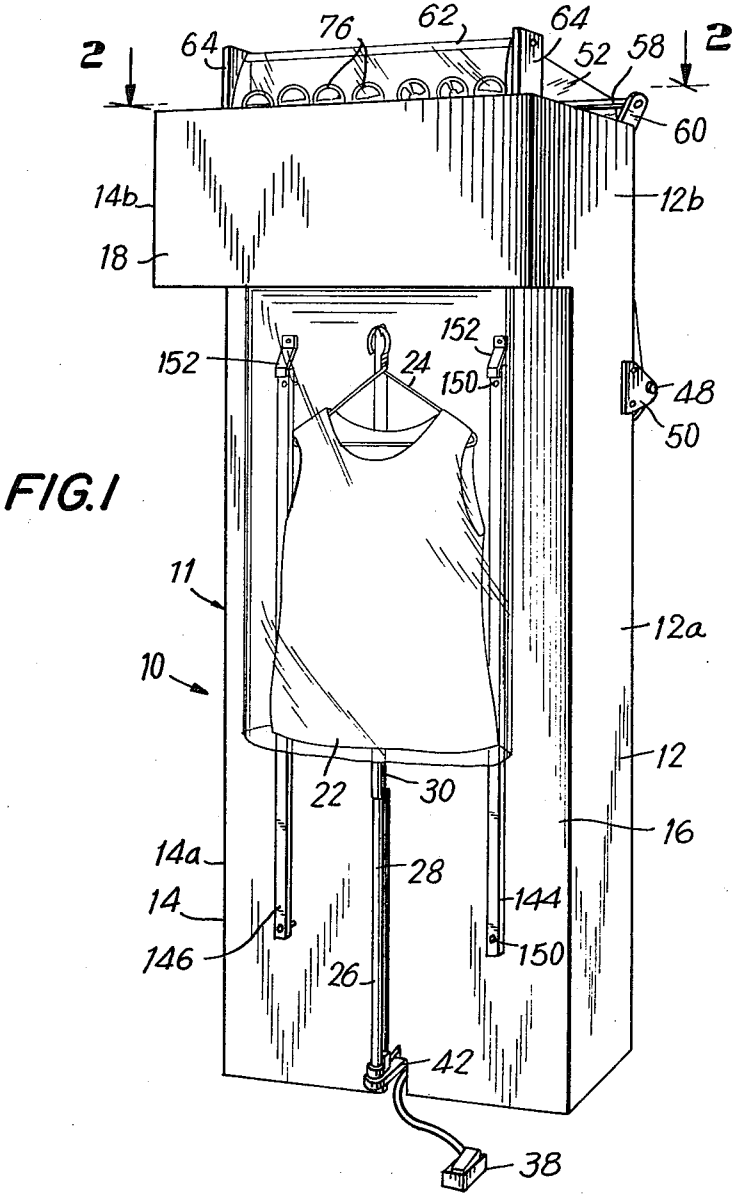
FIG. 1 is a front perspective view of a semi-automatic bagging machine, according to the present invention.
Figure 2:
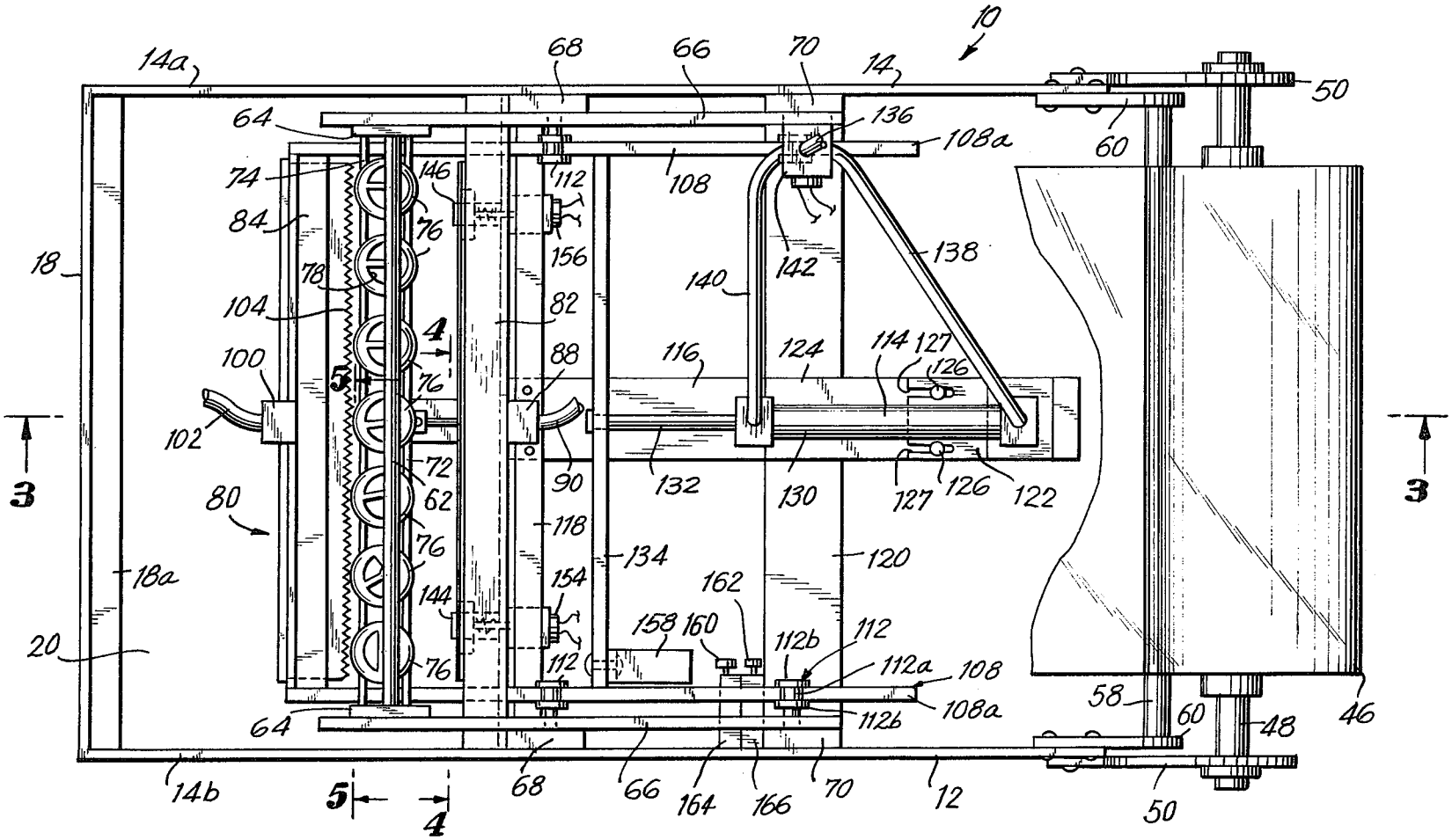
FIG. 2 is a top view, enlarged in scale, of the apparatus of FIG. 1, taken along the line 2—2 of FIG. 1.
Figure 3:
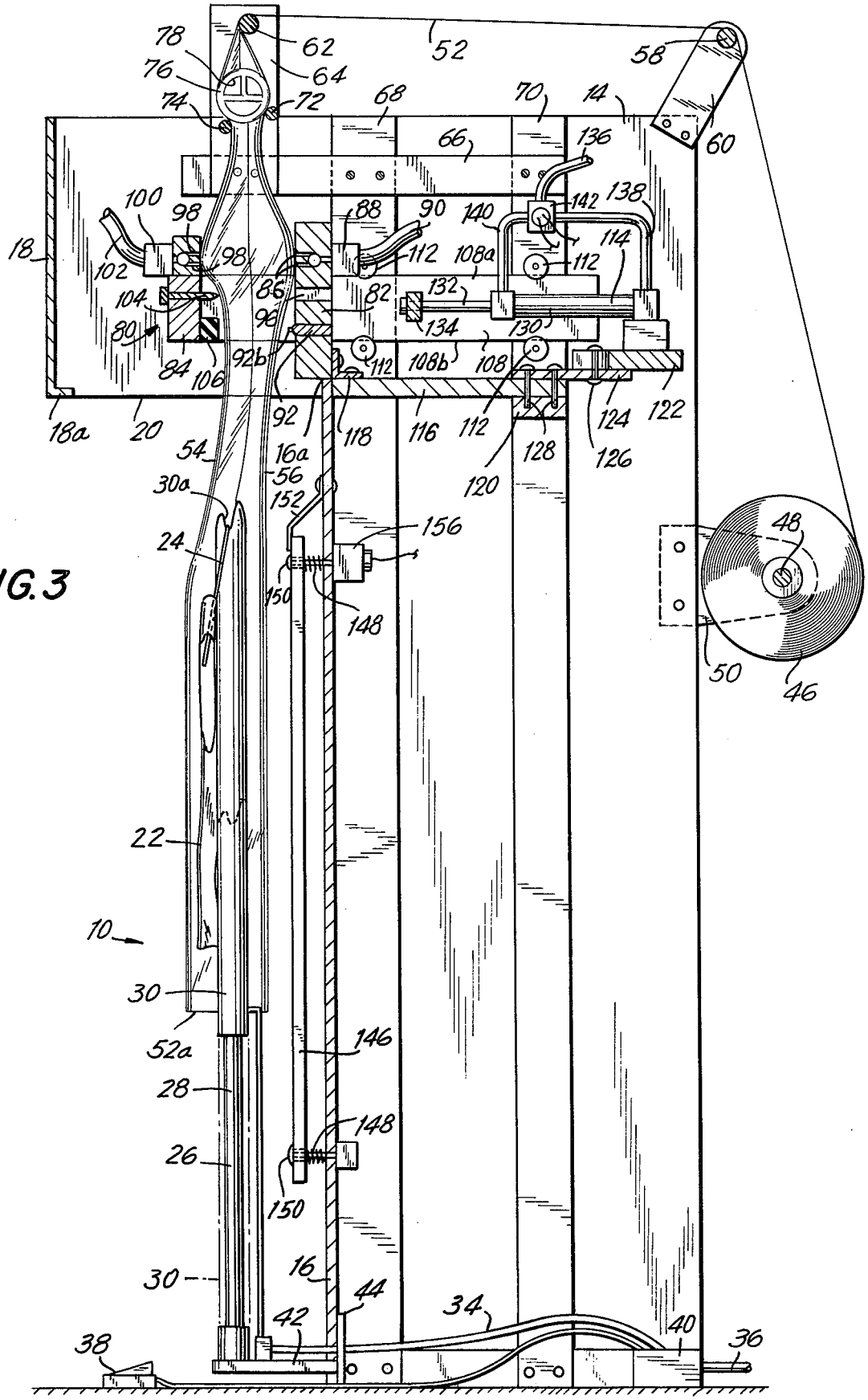
FIG. 3 is a sectional view, somewhat reduced in scale, taken along the line 3—3 of FIG. 2.

Referring now to the drawings and, more particularly, to FIGS. 1-3 thereof, a semi-automatic bagging machine according to the present invention is generally designated 10. The bagging machine includes a housing 11 having side walls 12 and 14, which are parallel to each other and which are the shape of an inverted "L". Thus, side wall 12 includes an "arm" portion **12*a* and a "leg" portion 12*b* and side wall 14, which is of substantially identical construction, has an "arm" portion 14*a* and a "leg" portion 14*b*. Housing 11 also includes a front wall 16 of a height substantially equal to the height of the "arms" of the side walls and which connects the two side walls together and a front wall 18, which connects the "legs" of the two side walls together. Front wall 18 thus extends outwardly from front wall 16, with the top 16*a* of the front wall 16 extending slightly above the bottom 18*a* of the front wall 18 (see FIG. 3). The "overhang", formed by front wall 18 and the legs 12*b* and 14*b* of the two side walls, is open at the bottom thereof, forming a passageway 20 for the travel of the tubular bagging material. The top, back and bottom of the bagging machine 10** may be open, if desired.

A clothing garment 22, for example, a dry-cleaned garment which is to be bagged, is carried on a conventional hanger 24. Means for supporting the clothing garment beneath passageway 20, so that the tubular material may be slipped over the garment, is provided and this takes the form of a foot-controlled support pole, generally designated 26. The support pole includes a stationary or base member 28 and a movable or slide member 30 which is adapted to slide up and down over the base member between an upward position, illustrated in solid line in FIG. 3, and a downward position, illustrated in phantom line in FIG. 3. Slide member 30 is usually maintained in its upward position by compressed air which is applied to the slide member 30 via conduits 32 and 34 from a source (not shown) coupled to conduit 36 (see FIG. 3). The movable or slide member 30 is usually maintained in its upward position by the compressed air, but the side member is caused to slide down over the base member to its downward position, when the operator of the bagging machine presses on foot pedal 38. The foot pedal controls a valve 40 and this causes the compressed air to be no longer supplied to the slide member. When the operator lifts his foot off the foot pedal, compressed air is then reapplied to the slide member, and the slide member moves from its downward position back to its upward position. The foot-controlled support pole 26 is mounted away from the front wall 16 of the housing in order to enable the tubular material to be pulled over the clothing garment. The support pole 26 is mounted away from wall 16 via a pedestal 42 which is connected to an appropriate support 44 located near the bottom and at the back face of front wall 16.

The bagging material, which is usually formed of a pliable polyethylene and having a normal thickness of several ten-thousandths of an inch, is supplied from a supply roll 46 which is mounted for rotation on an axle 48 at the rear of machine 10. The axle 48 is supported by brackets 50 disposed on the side walls 12 and 14 of the machine. The brackets are appropriately formed to enable the supply roll to be replaced with a new supply roll, as the polyethylene material is used up.

The polyethylene material from supply roll 46 takes the form of a continuous, tubular material 52, and the clothing garment 22 must be inserted into the tubular material in order to form the bag for the garment. As indicated hereinbefore, due to the nature of the polyethylene material, it has been exceedingly difficult to insert the clothing garment into the tubular material. More particularly, and referring to FIG. 3, the front face 54 and the back face 56 of the tubular material have a tendency to be attracted toward each other and to stick together, thereby making it exceedingly difficult for the tubular material to be pulled down over the garment. This problem is complicated by the fact that even if the front and back faces of the material are initially pulled apart, their tendency remains to be attracted toward each other, and this closes up the "tube", thereby rendering it very difficult to insert the garment into the material as the tubular material is pulled over the garment.

In order to overcome this distinct disadvantage, the semi-automatic bagging machine of the present invention utilizes means for spreading apart the front and back faces of the tubular material. This means not only separates these two faces, but it also causes the faces to go limp, overcoming the attractive nature of the two faces and maintaining the front face 54 and the back face 56 of the tubular material spread apart, even as the material is pulled over the garment.

More particularly, the bagging machine includes guide means for establishing the path for the tubular material from the supply roll 46, so that the material may be pulled over clothing garment 22. The guide means includes a first guide bar 58, which is supported by two brackets 60 located at the upper rear corners of side walls 12 and 14 and a second guide bar 62 disposed between brackets 64 located above passageway 20. The brackets 64 are mounted to appropriate side braces 66 which, in turn, are connected to support braces 68 and 70 which run from the top to the bottom of the side walls.

The brackets 64 also mount third and fourth guide bars 72 and 74 which are slightly offset one from the other, as indicated most clearly in FIG. 3. The third and fourth guide bars 72 and 74 support a series of independent spherical spreading balls 76, whose function is to untangle the tubular material 52 and to overcome the tendency of the front and rear faces 54 and 56 of the material to stick together, even after these two faces are pulled away from each other by the vacuum source of the bagging machine which will be described hereinafter. The spherical balls are advantageously of the type known as "wiffle" balls, that is, they are plastic, hollow, light in weight and have a series of openings or perforations 78 defined therein. Seven "wiffle" balls 76 are included in the embodiment of the machine disclosed in the drawings. It will be appreciated that the number of spreading balls is a function of the "width" of the tubular material and the size of an individual ball. Thus, the number of spreading balls should be sufficient so that the balls generally fill up the tubular material as the material is drawn through the guide bars 72 and 74, with the balls being able to rotate as the material is pulled through the bars. The balls are disposed on the two guide bars such that the balls form a ball row which is generally transverse to the travel of the tubular material across the row.

The four guide bars of the guide means thus define the path of travel of the tubular material 52. Specifically, the material travels from the supply roll 46, over first guide bar 58 and over second guide bar 62. The two faces of the tubular material are then separated by the series of spreader balls 76, which rest on the third and fourth guide bars 72 and 74, with the front face 54 of the material bearing against fourth guide bar 74 and the spreader balls and the back face 56 bearing against the third guide bar 72 and the spreader balls. The spreader balls function not only to untangle the material, which may be twisted or bunched together, for example between the first and second guide bars 58 and 62, but these balls, by some manner not entirely known, also function to break up the forces which cause the front and rear faces of the material to be attracted toward each other and to stick together. It is believed that the spreader balls, which are constructed as plastic spheres, break up the electrostatic field or forces within the tubular material. It has been found that the two faces of the material hang limply and are not attracted toward each other, even as the tubular material is pulled over the clothing garment, as a result of the action of the spreader balls which independently rotate within the tubular material and on the two supporting bars 72 and 74 as the material is pulled along its path.

After the front and rear faces 54 and 56 have been separated by the spreader balls 76, the tubular material passes through a cutting and sealing member, generally designated 80. The cutting and sealing member functions to effect a transverse seal between the faces of the tubular material and to sever or partially sever the material adjacent the seal after the tubular material has been pulled over garment 22, thereby forming an individual bag for the garment and a new leading end of the material for the next bag. The cutting and sealing member also includes a vacuum means for engaging and holding open the leading end of the tubular material, so that the leading end of the material may be grasped by the operator of the machine, helping the operator to pull down the material over the garment.

Figure 4:
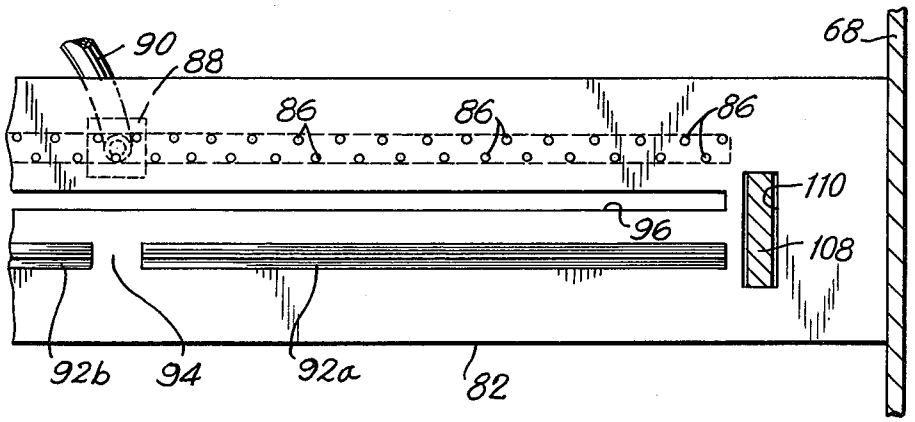
FIG. 4 is a partial sectional view, enlarged in scale, taken along the line 4—4 of FIG. 2.

The cutting and sealing member 80 includes a stationary arm 82 and a movable arm 84. The stationary arm 82 is mounted above passageway 20, for example, is supported by the support braces 68, with the stationary arm disposed across the width of the bagging machine. As illustrated in FIGS. 3 and 4, the stationary arm includes a series of vacuum holes 86, arranged in an appropriate array across a portion of the width of the stationary arm, i.e., in two "lines" as shown in FIG. 4. The vacuum holes are connected to a vacuum source (not shown) via a manifold 88 and a conduit 90 located on the rear wall of the stationary arm. Disposed beneath the vacuum holes is a heating member generally designated 92 comprising a heating element **92*a* and a heating element 92*b* which extend across the stationary arm in a manner to define a discontinuity 94 at the center of the stationary arm (see FIG. 4) at which place there is no heating element. A knife blade receiving slot 96 is also defined in the stationary arm, with the slot running across the width of the arm and intermediate the vacuum holes 86 and the heating member 92**.

Figure 5:
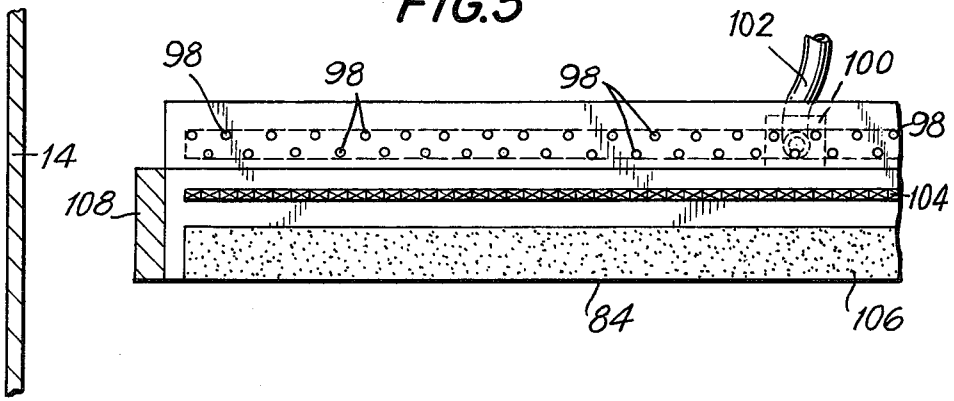
FIG. 5 is a partial sectional view, enlarged in scale, and taken along the line 5—5 of FIG. 2.

As illustrated in FIGS. 3 and 5, the movable arm 84 of the cutting and sealing member 80 is somewhat similar in construction to the stationary arm 82 and includes a series of vacuum holes 98 connected to a vacuum source via a maniforld 100 and a conduit 102. A knife blade element 104 is held by the movable arm, with the jagged end of the knife blade extending toward the stationary arm (see FIG. 2). As indicated in FIGS. 3 and 5, a resilient pad 106 extends outwardly from the movable arm toward staionary arm 82, the pad adapted to receive the heating elements **92*a* and 92*b* carried by the stationary arm, when the cutting and sealing member 80 moves to its cutting and sealing position, so that the movable arm 84 and stationary arm 82 are adjacent each other, as will be explained and as illustrated in FIG. 6**.

The movable arm 84 is mounted between two support arms 108 which pass through appropriate slots 110 defined in the stationary arm 82 (see FIG. 4). The support arms 103 are mounted for slidable movement in a series of rollers 112 rotatably mounted to the support braces 68 and 70. As illustrated in FIG. 3, two of the rollers are disposed along the top edge **108*a* of each support arm 108 while two of the rollers are disposed along the bottom edge 108*b* of each support arm. As shown in FIG. 2, each roller also defines an edge receiving surface 112*a*, which receives the bottom or top edge of the support arm, and two arm maintaining elements 112*b***, which function to maintain the top or bottom edges of the support arms on the "track" of the edge receiving surface.

The movable arm 84 is moved from its inoperative position (illustrated in FIG. 3) to its cutting and sealing position (illustrated in FIG. 6) by an air-actuated piston, generally designated 114. The air-actuated piston is supported by a support brace 116 which is connected, at one end thereof, via L-shaped bracket 118 to stationary arm 82 and which is connected, at the other end thereof, to a cross-support brace 120 which is connected between the support braces 70. The air-actuated piston 114 is adjustably connected to the support brace 116 via adjustably movable mounting members 122 and 124. These mounting members are held together, but can slide relative to each other, by fastening elements 126 disposed within slots 127 of mounting member 122. Mounting member 124, in turn, is connected to support brace 116 via appropriate fastening elements, such as bolts 128.

The air-actuated piston 114 includes a piston cylinder 130 and a movable piston arm 132 extending outwardly from the cylinder. The end of the piston arm 132 is connected to a cross member 134 which extends between the support arms 108 which carry the movable arm 84 of cutting and sealing member 80. Thus, as the piston arm 132 of the air-actuated piston moves back and forth, it causes the support arms 108 to slide back and forth on the rollers 112. Since the support arms 108 carry the movable arm 84 of the cutting and sealing member 80, this causes the movable arm 84 to move between its open position of FIG. 3 and its cutting and sealing position of FIG. 6.

The piston arm 132 is moved back and forth within piston cylinder 130 by a source of compressed air (not shown) which is connected via conduits 136, 138 and 140 to the piston cylinder. A control valve 142, disposed at the junction of the three conduits, is selectively energized, as will be explained hereinafter, so that the compressed air from conduit 136 is applied either to conduit 138 or conduit 140. As is generally known with piston devices of this type, the piston arm 132 will move in one direction or the other within the piston cylinder 130 depending on which of the conduits 138, 140 is supplied with compressed air.

The cutting and sealing member 80 moves from its inoperative position, wherein the movable arm 84 is in the position illustrated in FIG. 3, to its cutting and sealing position, wherein the movable arm 84 is in the position illustrated in FIG. 6, and back again, upon simultaneous actuation by the operator of two push bars 144 and 146 which are disposed along the front wall 16 of the machine. Both push bars are substantially identical and are normally biased away from the front wall by springs 148 which surround mounting bolts 150 and which secure the push bar to the front wall. A stop, in the form of a bracket 152 secured to the front wall 16, serves to limit the movement of the push bars away from the wall. Micro-switches 154 and 156 are disposed at the back of wall 16 and are actuated, respectively, when push bars 144 and 146 are pushed toward the wall 16, against the action of the biasing springs. Concurrent actuation of micro-switches 154 and 156 causes the control valve 142 to actuate the piston cylinder 130 in a manner which causes the piston arm 132 to move from the position shown in FIG. 3 to the position shown in FIG. 6. As indicated before, this causes similar movement of the movable arm 84 of the cutting and sealing member from the position shown in FIG. 3 to that of FIG. 6.

As shown in FIG. 2, the cross member 134, which moves along with the piston arm 132, carries a switch actuating member 158. As the movable arm 84 reaches the position illustrated in FIG. 6, the switch actuating member 158 actuates switch contacts 160 and 162 which actuate, respectively, micro-switches 164 and 166 causing the control valve 142 to switch the compressed air applied to the two conduits 138 and 140, thereby causing the piston arm to carry the movable arm 84 back to the position illustrated in FIG. 3.

FIG. 7 illustrates, in schematic form, the operation of the various push bars, micro-switches and the like which cause the piston arm 132 to move between the positions illustrated in FIGS. 3 and 6. As indicated in this figure, micro-switches 154 and 156 must be actuated simultaneously before the movable arm 84 is moved. This requirement of concurrent operation is represented by the output of "and" gate 168. The output from "and" gate 168 causes control valve 142, for example, via an appropriate relay 170, to control which of the air supply conduits, illustrated schematically at 172, is to apply compressed air to the air piston 130. The air piston 130 causes the piston arm 132 to move from the position illustrated in solid lines in FIG. 7 to that indicated in dashed line of the same figure, carrying the movable arm 84 from the solid line position to the dashed line position illustrated schematically in FIG. 7.

As the piston arm reaches its dashed line position, the switch actuating member 158 actuates switch contacts 160 and 162 causing actuation of micro-switches 164 and 166. Micro-switch 166 renders relay 170 inoperative, while micro-switch 164 actuates relay 174 located within control valve 142. Relay 174 acts on the air supply conduits 172 causing the air supplied to these conduits to "switch", thereby causing the piston arm 132 to return to its solid line position illustrated in FIG. 7.

The fact that the piston arm 132 will not move unless both of the micro-switches 154 and 156 are actuated is provided as a safety feature since these switches are actuated by the two push bars 144 and 146. Since the push bars can be actuated only when the operator uses both of his hands, this insures that the operator's hands will not be between the two arms of the cutting and sealing member 80 and therefore the operator will not be injured by the knife blade 104 which is carried by the movable arm 84, as the movable arm is moved. It should also be noted that it is not necessary for the operator to hold both push bars down during the entire sequence of movement of the cutting and sealing member. The operator merely presses on both of the push bars for a short period of time and this causes movement of the movable arm 84. Moreover, the control circuit of the machine is formed such that the movement of the movable arm 84 is of a "one-shot" type, so that even if the operator continues pushing on both push bars the cycle will not be repeated until the operator lifts both of his hands off the push bars.

Having now described the structure of the present invention, its operation may be readily understood as follows.

A clothing garment 22, carried by hanger 24, which the operator desires to "bag" is placed on the movable slide member 30 of foot-controlled support pole 36. An appropriate cutout or slit **30*a*** defined at the upper end of the slide member may be provided to hold the hanger and garment in place.

The operator then grasps the leading edge **52*a* of the tubular, polyethylene material, which is located approximately at the same level as cutting blade 104. The vacuum provided at vacuum holes 84 and 98 of the stationary arm 82 and movable arm 84 hold the faces 54 and 56 of the material apart and facilitate the operator in grasping the leading edge 52*a* of the material. The operator, grasping the leading edge 52*a*, then pulls the tubular material through the two open arms of the cutting and sealing member (which arms are in the position shown in FIG. 3), and draws the "tube" of material off of roll 46 until the clothing garment is covered. The spreader balls 76 greatly facilitate in this step since these balls, by a way not totally understood (although possibly relating to a break up of the electrostatic field), cause the front and rear faces 54 and 56** of the material of lie limp and this enables the tubular material to be readily, quickly and easily pulled down over the awaiting garment. Without these balls, the tendency is for the faces of the material to attract and to stick together, making it very difficult to insert the garment within the material tube, notwithstanding the action of the vacuum source which holds the faces apart at the arms of the cutting and sealing member.

After the desired amount of material has been pulled over the garment, the operator, using both hands, presses the push bars 144 and 146, and this causes the movable arm 84 to move from the position shown in FIG. 3 to the position illustrated in FIG. 6. Cooperation of the stationary and movable arms 82 and 84, at the position shown in FIG. 6, heatseals the faces 54 and 56 of the tubular material together by providing a transverse seal across the tubular material at this location. The two arms also perforate the material adjacent and slightly above the seal. The two faces are not sealed together across the entire width of the material, since the faces are not sealed at approximately the mid-point of the tubular material, corresponding to the discontinuity 94 between the two heating elements **92*a* and 92*b* of the heating member 92**. This enables the hanger hook to be disposed out of the bag, so that the garment may be hand carried.

After the perforations have been formed and the seal made, the movable arm 84 automatically moves back to its position indicated in FIG. 3. The operator then pulls the material which is substantially over the garment down, tearing the material at the perforations. This results in a new leading edge for the next bag. The bag which is over the garment is pulled down and its hanger is grasped by the operator.

The operator then steps on the foot pedal 38, which causes the movable slide member to move from its upward to its downward position leaving the bagged garment in the operator's hand. The operator then places the bagged garment in an appropriate place, lifts his foot off the foot pedal (which causes the movable slide member 30 to raise to its upward position) so that the next garment may be placed on the foot-controlled support pole and be bagged.

Although the invention has been described with reference to a particular embodiment, it is to be understood that this embodiment is merely illustrative of the application of the principles of the present invention. For example, although the spreader balls have been shown as useful in the semi-automatic bagging machine described above, it is readily apparent that the concept of using these independently rotatable, hollow, plastic perforated balls to untangle and cause the faces of bagging material to become limp has wide applicability in automatic bagging devices or in any apparatus which utilizes a polyethylene material formed in a continuous tubular configuration wherein the faces of the material have a tendency to stick together. For example, this concept may be used in an apparatus of the type disclosed in copending application Ser. No. 722,322, filed in the name of Vincent N. Vulcano and Maurice W. Friedman for Automatic Bagging Machine, filed concurrently herewith. Similarly, although the clothing garment has been described as a dry-cleaned or laundered one, it will be appreciated that the invention may be used with newly manufactured garments or similar articles which are to be inserted into polyethylene bags. Thus, it is to be understood that numerous modifications may be made in the illustrative embodiment of the present invention and other arrangements may be devised, without departing from the spirit and scope of the invention, as set forth in the following claims.

What is claimed is:

1. In a bagging machine for sequentially forming individual bags for clothing garments comprising a supply means for supplying a continuous, tubular bagging material having a leading edge defining an open end for the bag, a garment support means for supporting a garment to be bagged for insertion of the garment into the tubular bagging material through the open end of the bag, guide means for establishing a path for the tubular bagging material from the supply means to the garment support means, and means selectively operable for providing a transverse seal between the opposite faces of the tubular bagging material and for at least partially severing the tubular bagging material adjacent the seal so that when the tubular bagging material is pulled over the garment the material forms a bag for the garment and a new open end for the next bag the improvement comprising means for untangling the tubular bagging material and for spreading and maintaining apart the opposite faces of the tubular bagging material including a plurality of hollow spherical balls, each of said balls having a plurality of perforations and being disposed within the tubular bagging material and supported by said guide means for individual rotation of each of the balls within the tubular bagging material.

2. A bagging machine for sequentially forming individual bags for clothing garments according to claim 1 wherein said guide means includes a first guide bar and a second guide bar for supporting said spherical balls, said spherical balls resting on said first and second guide bars and further wherein one face of the tubular bagging material passes between the spherical balls and the first guide rod and the second face of the tubular bagging material passes between the spherical balls and the second guide rod.

3. A bagging machine for sequentially forming individual bags for clothing garments according to claim 2 wherein said first guide rod and said second guide rod are parallel and off-set with respect to each other.

4. A bagging machine for sequentially forming individual bags for clothing garments according to claim 2 further comprising vacuum means for engaging and holding open the faces of the tubular bagging material.

5. A bagging machine for sequentially forming individual bags for clothing garments according to claim 2 wherein said garment support means is selectively moved between a first position and a second position for removing the garment from the support means.

6. A bagging machine for sequentially forming individual bags for clothing garments according to claim 2 wherein said means for providing a transverse seal between the opposite faces of the tubular bagging material and for at least partially severing the tubular bagging material adjacent the seal is movable between a first position wherein said tubular bagging material passes through said sealing and severing means and a second position wherein said tubular bagging material is sealed and at least partially severed by said sealing and severing means.

* * * * *